US006003664A

United States Patent [19]

Dolan

[11] Patent Number: 6,003,664

[45] Date of Patent: Dec. 21, 1999

[54] FOLDABLE CONTAINER HAVING DISPLAY PORTION ACTING AS SOURCE INDICIA

[75] Inventor: John W. Dolan, Boothwyn, Pa.

[73] Assignee: W. L. Gore & Associates, Inc., Newark, Del.

[21] Appl. No.: 08/937,417

[22] Filed: Dec. 6, 1996

[51] Int. Cl.[6] ..... A61B 19/02; B65D 17/32

[52] U.S. Cl. ..... 206/45.29; 40/312; 206/63.5; 206/768; 229/125; 229/243

[58] Field of Search ..... 206/45.28, 45.29, 206/767, 63.5, 768; 229/243, 125; 40/312

[56] References Cited

U.S. PATENT DOCUMENTS

| | | | |
|---|---|---|---|
| D. 118,010 | 12/1939 | Broderick | 206/45.29 X |
| D. 387,979 | 12/1997 | Dolan | D9/415 |
| 476,765 | 6/1892 | Knapp | 206/45.28 |
| 1,609,186 | 11/1926 | Peruzzi | 206/45.29 |
| 1,800,550 | 4/1931 | Mahoney et al. | 206/45.29 X |
| 1,903,461 | 4/1933 | Keller | 206/45.28 X |
| 2,072,695 | 3/1937 | Wellman . | |
| 2,148,533 | 2/1939 | Chapman | 206/45.29 |
| 2,319,919 | 5/1943 | Clark | 206/45.29 X |
| 2,337,596 | 12/1943 | Garniepy | 206/45.29 |
| 2,495,676 | 1/1950 | Wells | 206/45.29 X |
| 3,347,356 | 10/1967 | Kossnar | 206/45.29 |
| 3,674,133 | 7/1972 | Locke | 206/767 |
| 4,860,886 | 8/1989 | Northrup et al. | 206/45.29 |
| 5,246,022 | 9/1993 | Israel et al. | 206/63.5 X |

FOREIGN PATENT DOCUMENTS

| | | |
|---|---|---|
| 40 42 103 | 7/1992 | Germany . |
| 295 19 931 | 2/1996 | Germany . |

*Primary Examiner*—Bryon P. Gehman
*Attorney, Agent, or Firm*—Allan M. Wheatcraft

[57] ABSTRACT

A foldable shipping container, having a main body and first and second side wall panels, which in an assembled configuration forms a display container, wherein a display portion is detached from the main body at a predetermined separation region to form an erected display panel and wherein each of the first and second side wall panels includes a detachable access panel.

6 Claims, 6 Drawing Sheets

FOLDABLE CONTAINER HAVING DISPLAY PORTION ACTING AS SOURCE INDICIA

FIELD OF THE INVENTION

This invention generally relates to foldable containers for the packaging and shipment of small articles and the subsequent display of such articles at a point of distribution. More specifically, this invention relates to a foldable container having a display portion for displaying the source indicia or other identifiers relating to the articles contained therein.

BACKGROUND OF THE INVENTION

It is often desirable to provide a container which can be used for both the shipment of small articles and the subsequent display of such articles at a point of distribution. Paperboard containers are particularly favorable for this purpose because of their relative ease of manufacture and low cost of production.

From a production standpoint, a paperboard container may be formed from a single flat sheet of paperboard or other suitable material which has been cut to a predetermined shape. Through a series of folding and gluing operations this flat sheet of paperboard can be transformed into a container of generally rectangular configuration suitable for packaging articles.

Additionally, because a paperboard container is formed from a single flat sheet of material, it is particularly well adapted to applying printed material to its surfaces. The printing is typically applied to selected surfaces of the unfolded paperboard which form the outwardly exposed surfaces of the paperboard container in its folded state. These surfaces may be coated prior to printing to provide a smooth printable surface.

When a shipping container will also be used as a display means at a point of distribution, a removable container wall may be provided for accessing the contents of the container. Frequently, the removable wall, providing access to the contents of the container, will have perforations about its periphery to facilitate removal thereof.

In some instances a removable container wall is provided, wherein the container wall remains hingedly attached to the container rather than being entirely removed. This hingedly attached wall may be imprinted on its inside surface, such that when the hinged wall is folded away from the container, the wall's inner surface is directly visible to a person accessing the contents of the container. The inner surface of the hingedly attached wall functions as a billboard for advertising the contents of the container. This type of container configuration is prevalent in consumer products markets, where a corrugated shipping container is converted to a display bin at the point of distribution.

One of the disadvantages of such an arrangement is that the paperboard container in its unfolded state must be subjected to two separate printing operations. This is necessary to apply printed media to both the outer surface of the container, as well as the inner surface of the hingedly attached wall, to permit the wall to function as an advertising billboard. Furthermore, printing on both surfaces of the unfolded paperboard carton may require the additional coating of the inside surfaces of the container which will contain printed media. These additional manufacturing operations require added time and expense in the production of such dual function paperboard containers.

Another disadvantage of conventional shipping/display containers is their inability to accommodate billboards of varying size, while still providing sufficient accessibility to the entire container interior. Existing containers typically utilize a billboard which completely encloses the top surface of the container. The billboard is hinged at the rear of the container at the junction between the top wall and back wall. This structure allows access to the entire interior of the container. An undesirable consequence of this design is that the billboard height increases proportionately with an increase in container depth. In instances where the available head room at a display location is limited, a tall billboard cannot be displayed. In such instances, the billboard is typically completely removed from the container and discarded.

Another disadvantage of conventional shipping/display containers is that when the individualized articles housed in the container are sized such that their height and width dimensions closely match those of the container, the edges of the article are not easily accessible and it becomes difficult to grasp and remove such individual articles from the container.

Yet another disadvantage of conventional shipping/display containers is that they require an added support structure to maintain the billboard in its unfolded or vertical display position. When a hinged container wall is used as a display billboard, it is either left freestanding in an unfolded display position, or it may be attached to an additional support structure separately provided. In the case of a freestanding billboard, any disturbance of the container (e.g., someone accessing the contents) may cause the billboard to shift from its substantially vertical orientation. This shifting may result in a billboard orientation in which the advertising media contained thereon is no longer directly visible to a consumer accessing the contents of the box.

The foregoing illustrates limitations known to exist in present designs of shipping/display containers. Thus, it is apparent that it would be advantageous to provide an improved display container directed to overcoming one or more of the limitations set forth above. Accordingly, a suitable alternative is provided including features more fully disclosed hereinafter.

SUMMARY OF THE INVENTION

In accordance with the teachings of the present invention, a foldable container is provided having a main body. The main body includes a top wall panel having a display portion connected to the main body at a fold region. The display portion is separable from the main body at a predetermined separation region. The display portion includes first and second display panels which are hingedly connected by a fold. The main body further includes front and back wall panels which are each hingedly connected to the main body by a fold. First and second side wall panels are also provided and are each hingedly connected to the main body by a fold. A bottom panel having a connecting flap hingedly attached thereto is hingedly connected by a fold to the first side wall panel. In a folded or assembled configuration, the main body forms a display container wherein the display portion is detached from the main body at the predetermined separation region and folded at the fold connecting the first and second display panels to form an erect display panel.

In one embodiment of the present invention, first and second side wall panels each contain a removable access panel to facilitate the removal of articles from the foldable container.

In another embodiment of the present invention, a notch is provided in the front wall panel to facilitate the separation of the display portion from the main body.

In yet another embodiment of the present invention, the erect display panel has the same shape as the individual articles contained therein.

It is therefore a purpose of the invention to provide a shipping container which can be readily converted to a display bin having a header or billboard in the general configuration of the individual packaging of the articles contained therein.

It is another purpose of the present invention to provide a shipping/display container in which the articles contained therein are easily accessible when the height and width of the individualized articles match the height and width dimensions of the container.

It is another purpose of the present invention to provide a shipping/display container in which the billboard is secured in an erect orientation when the container is converted to the display configuration such that the billboard is clearly visible to a person observing or accessing the contents of the box.

It is yet another purpose of the present invention to provide a shipping container which is readily convertible to a display bin which is simpler, quicker and consequently more cost effective to produce then a conventional shipping/display carton.

BRIEF DESCRIPTION OF THE DRAWINGS

The foregoing summary, as well as the following detailed description of a preferred embodiment of the invention, will be better understood when read in conjunction with the appended drawings. For purposes of illustrating the invention, there is shown in the drawings an embodiment which is presently preferred . It should be understood, however, that the invention is not limited to the precise arrangement and instrumentality shown. In the drawings.

DETAILED DESCRIPTION OF THE INVENTION

Figure 1:
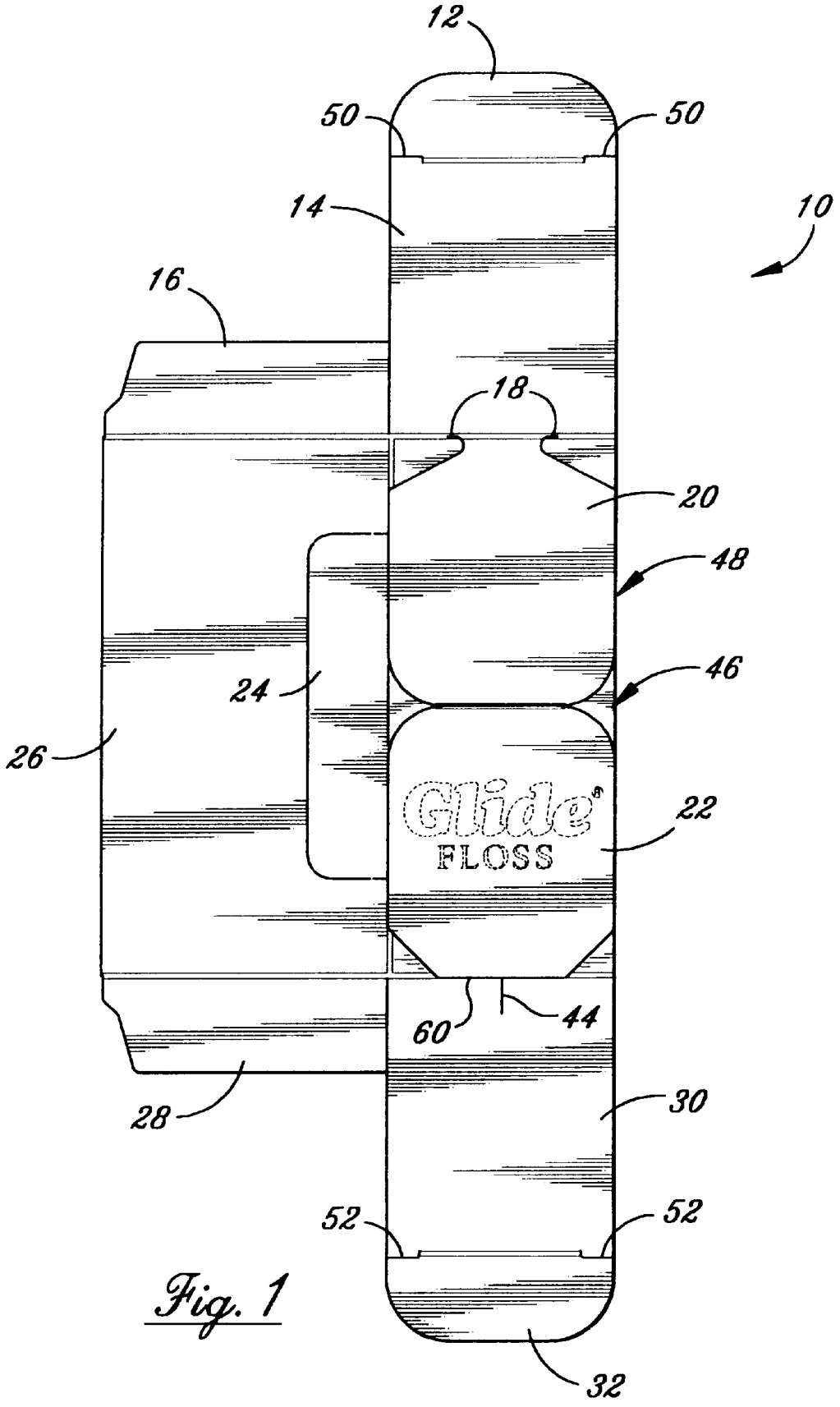
FIG. 1 is a top plan view of a partially assembled foldable container of the present invention in a flattened state, wherein a connecting panel extending from a bottom wall has been adhered to the corresponding side wall of the foldable container to form a continuous loop.

Referring now to the drawings, wherein similar reference characters designate corresponding parts throughout several views, the foldable container of the present invention is generally illustrated at 10 in FIGS. 1 through 6 in various stages of assembly.

Turning to FIGS. 1–6, foldable container 10 is defined by a main body 11. As understood by one skilled in the art, main body 11 is dimensioned from a suitable sheet material, such as but not limited to a paperboard material, for example. Main body 11 may be dimensioned in a conventional manner, such as by use of die-cutting, water jet cutting, industrial lasers or by cutting blades, for example.

The die-cut paperboard container main body is defined by a series of rectangular wall panels including back wall panel 14, front wall panel 30, side wall panel 26, side wall panel 34, bottom wall panel 36, and top wall panel 46, interconnected by folds.

Figure 3:
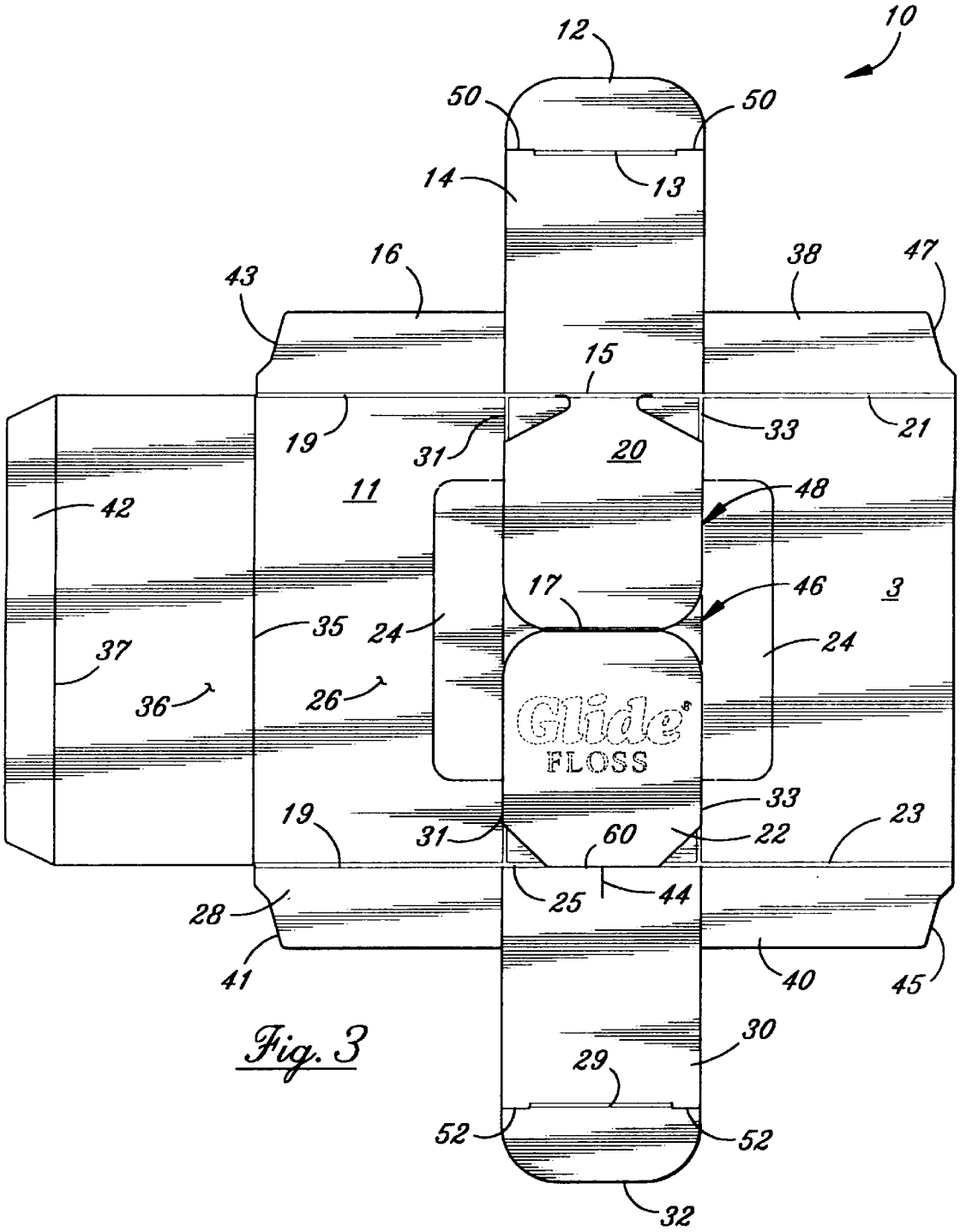
FIG. 3 is an unassembled plan view of the foldable container of FIG. 1.

As seen in FIGS. 1 and 3, top wall panel 46 defines the top wall of the foldable container of the present invention in its assembled condition. Top wall panel 46 is generally rectangular in configuration and includes a display portion 48 comprising first and second display panels 20 and 22 connected by a fold 17. Display portion 48 is further connected by the fold 15 to main body 11. Notches 18 are provided along the fold connecting display portion 48 to main body 11. Notches 18 secure the display portion of the top wall in a substantially vertical or erect position when the container is disposed in its display orientation. At least one predetermined separation region 60 is additionally provided along a portion of the periphery of display portion 48 to selectably secure the display portion 48 to the main body 11 during packaging and shipping. In one embodiment of the present invention, display panels 20 and 22 are shaped substantially identical to the shape of unique packaging of the individual articles housed therein. In such an embodiment, the shaped display panels 20 and 22 are helpful in developing consumer recognition and good will of the uniquely shaped packaged articles.

Back wall panel 14 defines a rear wall of the foldable container of the present invention in its assembled condition. Back wall panel 14 is generally rectangular in configuration and is hingedly connected to main body 11 at its inner edge at fold 15. Back wall panel 14 is further hingedly connected to tab 12 along fold 13 having slots 50. Tab 12 is generally rounded in configuration, and is located in the interior of the container in its assembled configuration, such that tab 12 is interlockingly positioned with flaps 16 and 38 at slots 50, thereby maintaining back wall panel 14 in a closed position relative to the assembled foldable container main body 11.

Front wall panel 30 defines a front wall of the foldable container of the present invention in its assembled condition. Front wall panel 30 is generally rectangular in configuration and is hingedly connected to main body 11 at its inner edge at fold 25. Front wall panel 30 is further hingedly connected to tab 32 along fold 29 having slots 52. Tab 32 is generally rounded in configuration and is located in the interior of the container in its assembled configuration, such that tab 32 is interlockingly positioned with flaps 28 and 40 at slots 52, thereby maintaining front wall panel 30 in a closed position relative to the assembled foldable container main body 11. In one embodiment of the present invention, front panel 30 includes notch 44 which facilitates the detachment of the display portion 48 of the present invention from the main body 11.

Side wall panel 26 defines a first side of the foldable container of the present invention in its assembled condition. Side wall panel 26 is generally rectangular in configuration and is connected by folds 31 to main body 11. Side wall panel 26 further includes flaps 16 and 28 connected thereto along folds 19. Flaps 16 and 28 are generally rectangular in configuration and include detents 43 and 41, respectively. When the container of the present invention is in an assembled conditioned, flaps 16 and 28 are located interiorly and against back and front wall panels 14 and 30, respectively, wherein detents 43 and 41 interlock with tabs 12 and 32. Side wall panel 26 is further connected to bottom wall panel 36 along fold 35.

Side wall panel 34 defines a second side of the foldable container of the present invention in its assembled condition. Side wall panel 34 is generally rectangular in configuration and is hingedly connected to main body 11 along folds 33. Side wall panel 34 further includes flaps 38 and 40 connected thereto along fold lines 21 and 23, respectively. Flaps 38 and 40 are generally rectangular in configuration and include detents 47 and 45, respectively. As described previously with regard to the first side wall panel of the present invention, in the assembled configuration of the foldable container of the present invention, flaps 38 and 40 are located interiorly against back and front wall panels, 14 and 30 respectively, wherein detents 47 and 45 interlock with tabs 12 and 32.

In one embodiment of the foldable container of the present invention, first and second side wall panels 26 and 34 include access panels 24, which are perforatably attached thereto, and which may be removed at the point of distribution. Removal of the access panels 24 facilitates the removal of articles contained therein by permitting the articles to be easily grasped at their edges, which are otherwise flush with the container walls.

Figure 2:
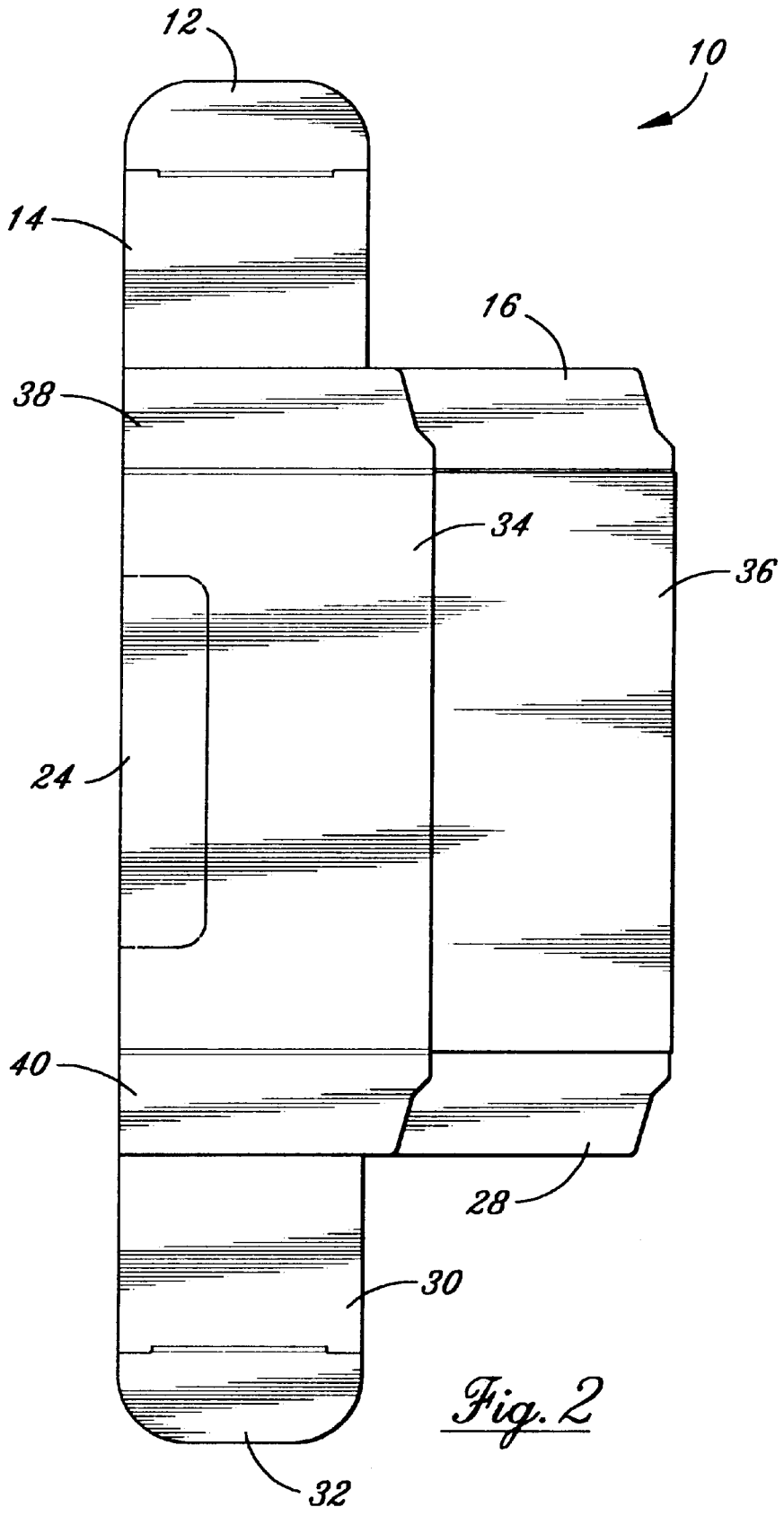
FIG. 2 is a bottom plan view of the foldable container of FIG. 1.

Bottom wall panel 36, which is connected at fold 35 to side wall panel 26, is generally rectangular in configuration and defines the bottom of the foldable container of the present invention in its assembled configuration. Bottom wall panel 36 further includes connecting panel 42 which is connected thereto along fold 37. Connecting panel 42 is secured to side wall panel 34 during assembly to form a continuous loop of the foldable container of the present invention as shown in FIGS. 1 and 2.

In manufacture, a single sheet of suitable material, such as paperboard, is die-cut in a pattern as shown in FIG. 3. The material may contain a surface coating to provide an improved printing surface. Coating techniques for providing improved printing surfaces are commonly known by those skilled in the art. Preferably any suitable coating is applied prior to patterning the material. Following patterning and coating the material sheet, the sheet is printed in a predetermined fashion.

Once the material sheet has been patterned and printed, it is in condition for assembly. To assemble the foldable container of the present invention, connecting flap 42 is affixed to the inner surface of side wall panel 34 along its outermost edge. Any suitable adhesive or mechanical fastening means can be used to secure the connecting flap 42 to the side wall panel 34. At this stage, the container box remains in a substantially flattened state as best shown in FIGS. 1 and 2, with side walls 26, 34 lying in a horizontal plane together with top and bottom walls 46 and 36.

Figure 4:
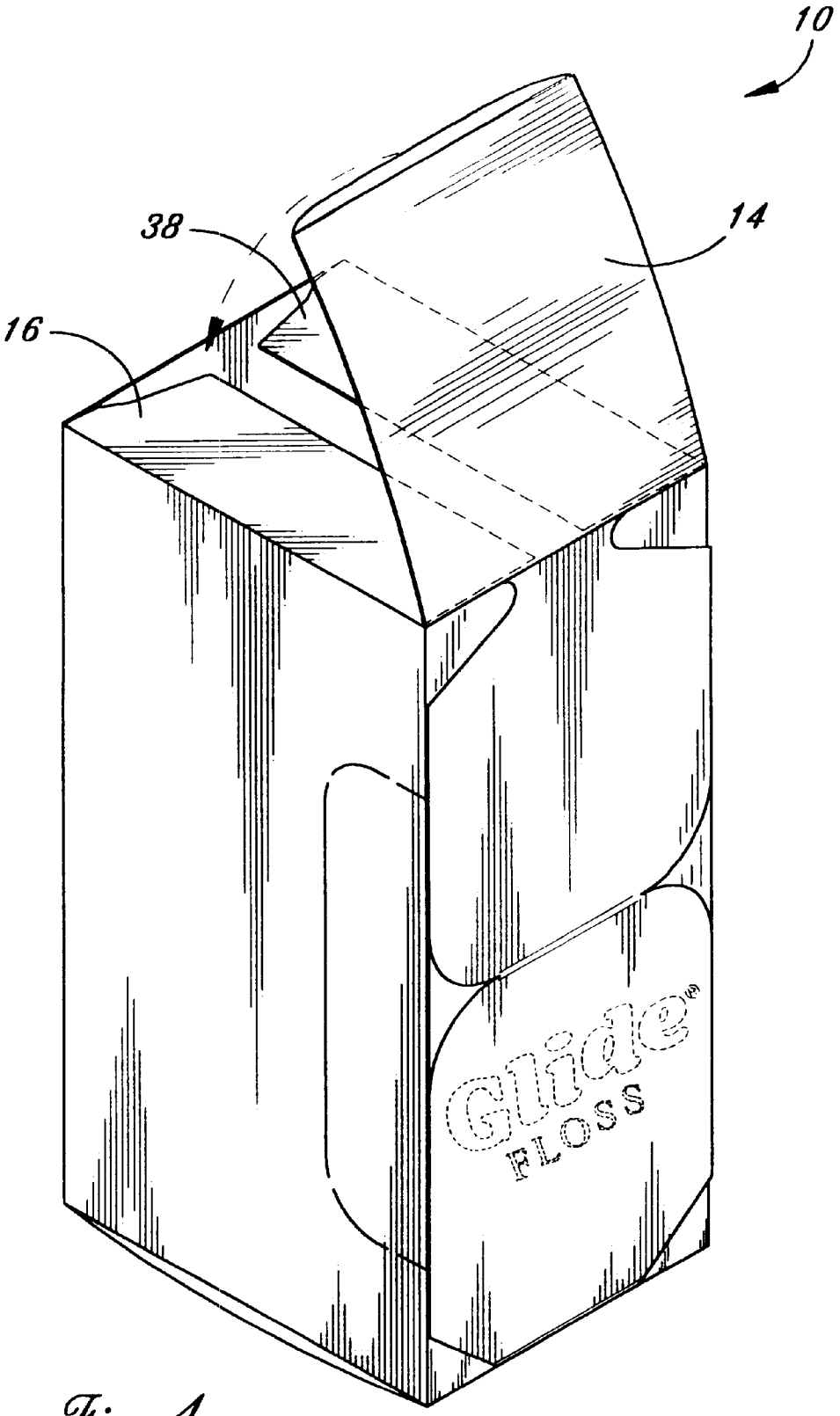
FIG. 4 is a partially assembled perspective view of the foldable container of the present invention.

Following the procedure described above, the substantially flattened foldable container can be expanded by rotating side walls 26, 34 from a horizontal position, to a position which is substantially vertical in orientation and perpendicular with respect to top and bottom walls 46, and 36. Flaps 16, 28, 38 and 40 are then folded inward, whereafter front wall 30 and back wall 14 may be folded downward over the respective flaps, and tabs 12 and 32 are interlockingly positioned with respect to the flaps such that the front and back walls are secured in a closed position. This procedure is best illustrated in FIG. 4 which depicts a partially assembled container of the present invention showing the flaps 16, 38 folded inward and further depicting the direction of movement of the back wall panel 14 as it is folded into a closed position. Prior to closing both container ends, articles to be packaged and shipped can be disposed therein.

Figure 5:
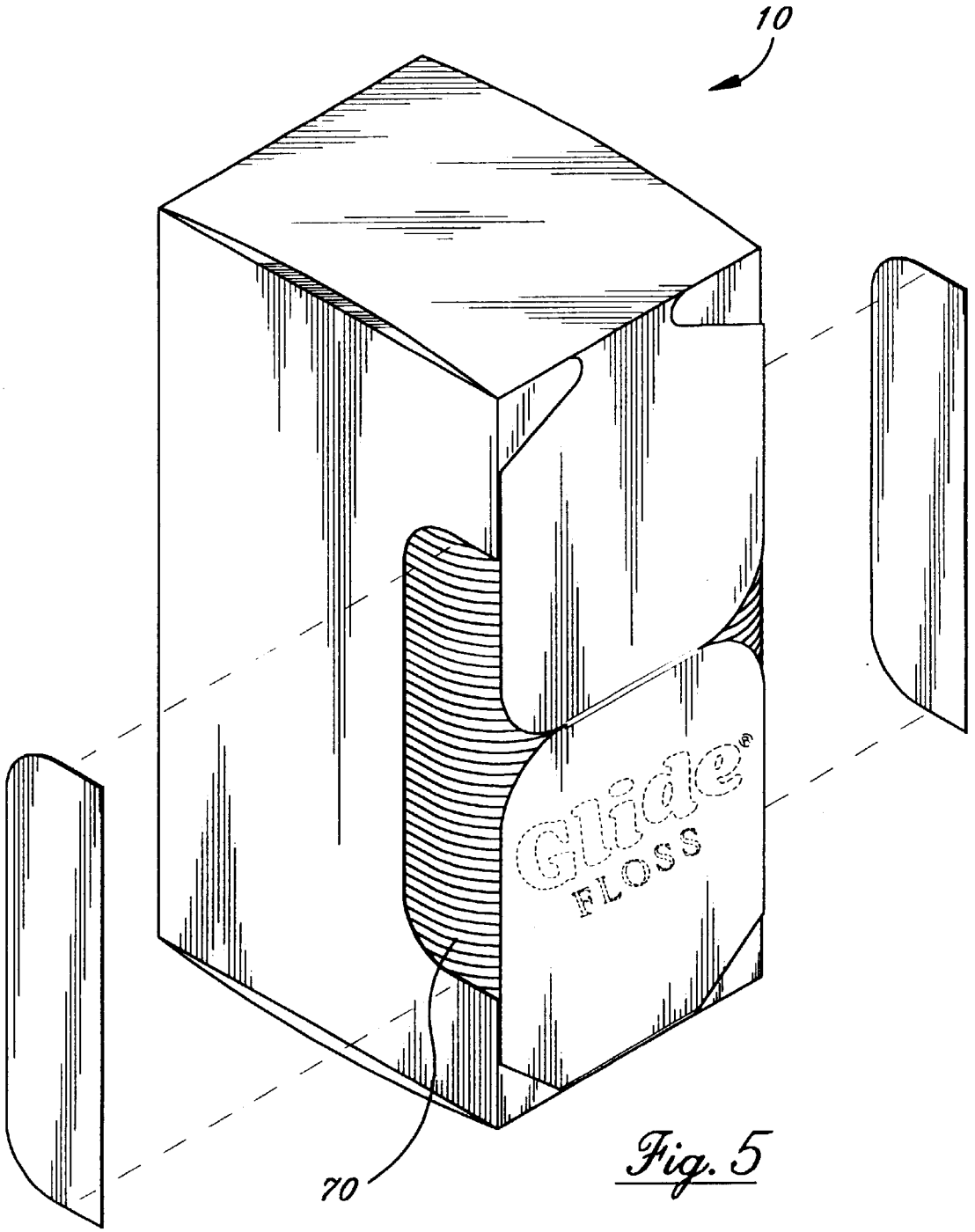
FIG. 5 is a perspective view of an assembled foldable container of the present invention showing the access panels removed and having articles contained therein.
Figure 6:
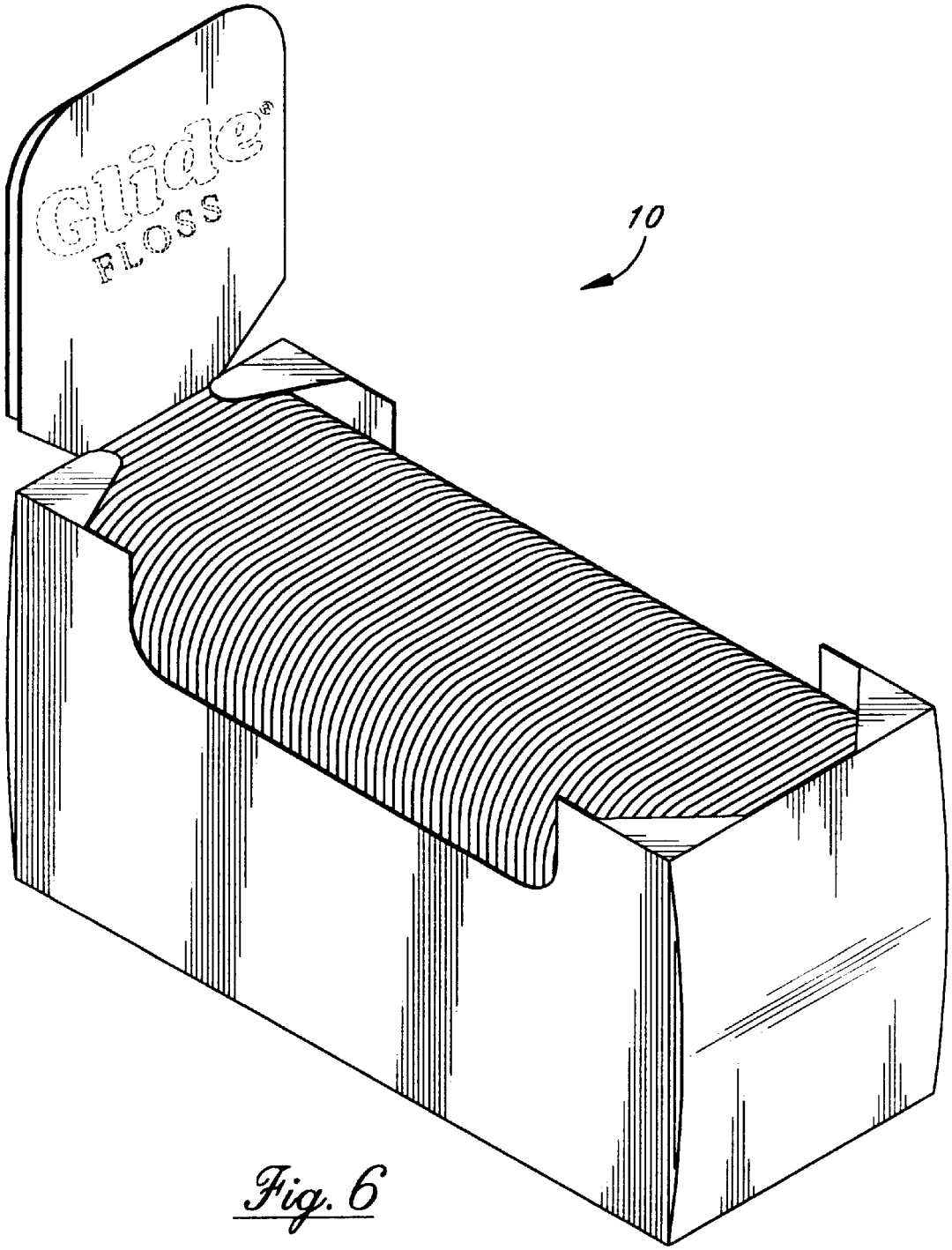
FIG. 6 is a perspective view of an assembled foldable container which has been converted to a display configuration with articles contained therein.

After the packaged goods have been shipped to a destination, the foldable container of the present invention can be converted to a display configuration. FIG. 5 shows the foldable container of the present invention having articles 70 disposed therein. The access panels 24 have been removed to reveal the enclosed articles. To erect the display portion 48, it is first necessary to sever the display portion from the main body at the separation region 60 which secures the display portion 48 to main body 11. To assist the user in this procedure, notch 44, as seen in FIG. 3, is provided in front wall panel 30. Notch 44 intersects the fold 25 connecting front wall panel 30 to top wall panel 46. By depressing notch 44, the front wall panel 30 is caused to temporarily buckle, at which time the display portion 48 of the top wall panel 46 will protrude slightly beyond the front wall panel and can be grasped along its frontmost portion and lifted, severing any perforations or attachments at separation region 60. The display portion 48 is then folded outward along the fold 15. With the display portion oriented in a substantially vertical position, the first display panel is folded downward along the fold 17. To secure the display panel in this position, the lower edge of front display panel 22, as shown in FIG. 6, is interlocked with notches 18 provided at the fold 15.

The container of the present invention may be particularly useful in the field of dentistry, where a particular consumer market may be targeted for the promotion of a consumable product, such as dental floss, for example.

An individual visiting a dentist's office for scheduled dental work or routine examination will be required to spend some amount of time sitting in a dentist's chair. During this time, it is a natural tendency of the dental patient who is confined to an immobile position in the dentist's chair to scan the surroundings of the office. This situation provides a unique advertising opportunity, wherein a visual display within the view of the patient may be particularly effective in promoting a consumer product.

In accordance with the foldable container of one embodiment of the present invention, it may be desirable to provide a display container for individualized samples of dental floss. The display panels 20 and 22 may be dimensioned to resemble the unique shape of a dental floss package. A dentist performing work on a patient may require a person to floss in the office, or may try to encourage a patient to floss regularly at home. To provide the patient with a means to floss, it may be desirable for the dentist to have individualized floss packets available in the office. A display container provided for the dentist's office not only serves the need of a dentist in having readily available floss packets for patient use, it also provides an effective marketing tool.

An offering, by the dentist, of an individual sample of a dental floss product may be in the form of retrieving a sample from the container and handing it to a patient, or allowing the patient to retrieve a sample from the container. In either scenario, the patient's attention would be directed to the prominent, uniquely shaped display billboard as the sample was being retrieved. Furthermore, the patient would have the opportunity to observe the individualized packaging of the floss product, which may also bear the same indicia and shape as the billboard display, thereby providing further visual reinforcement of brand recognition. If the patient then uses the floss and is pleased with the product, the person will remember the source indicia of the product and be inclined to maintain brand loyalty when purchasing additional supplies.

While the present example is directed to the distribution and promotion of a dental floss product in the dentist's office, other applications of the present invention may be envisioned such as providing individualized product packets in other medical fields or for nonmedical uses such as providing individualized product packets of floss, toothpaste, shampoos, soaps and the like for hotel guests for example.

Although a few exemplary embodiments of the present invention have been described in detail above, those skilled in the art readily appreciate that many modifications are possible without materially departing from the novel teachings and advantages which are described herein. Accordingly, all such modifications are intended to be included within the scope of the present invention, as defined by the following claims.

Having described the invention, what is claimed is:

1. A foldable container for packaged articles, said foldable container comprising:

a top wall panel having a display portion, said display portion having at least first and second display panels, said first and second display panels being hingedly connected by a fold;

a front wall panel having an inner edge hingedly connected to said top wall panel by a fold and separably connected to said display portion of said top wall panel at a separation region, said display portion being separable from said front wall panel at a separation region;

a back wall panel having an inner edge hingedly connected to said top wall panel by a fold;

first and second side wall panels, each side wall panel having an inner edge interconnected by a fold to said top wall panel, and each of said first and second side wall panels including a detachable access panel; and a bottom wall panel hingedly connected by a fold to one of said first and second side wall panels, said bottom wall panel including a connecting flap;

wherein in a folded configuration, the container forms a display container, and said display portion is detached from said front wall panel at said separation region and folded along said fold between said first and second display panels, the folded first and second display panels thereby forming an erect display panel.

2. A foldable container as claimed in claim 1, wherein said erect display panel includes printed material acting as a source indicia.

3. A foldable container as claimed in claim 1, further comprising an individual packaged article having a shape contained in said container, and wherein said erect display panel has a shape that is substantially the same as the shape of said individual packaged article.

4. A foldable container as claimed in claim 1, wherein said front wall further comprises a notch for detaching said display portion.

5. A foldable container for packaged articles, said foldable container comprising:

a top wall panel having a display portion, said display portion having first and second display panels, said first and second display panels being hingedly connected by a fold;

a front wall panel having an inner edge hingedly connected to said top wall panel by a fold and separably connected to said display portion of said top wall panel at a separation region, said display portion being separable from said front wall panel at a separation region, said front wall panel having a notch to facilitate the separation of said display portion from said main body;

a back wall panel having an inner edge hingedly connected to said top wall panel by a fold;

first and second side wall panels, each side wall panel having an inner edge interconnected by a fold to said top wall panel, and each of said first and second side wall panels including a detachable access panel; and a bottom wall panel hingedly connected by a fold to one of said first and second side wall panels, said bottom wall panel including a connecting flap;

wherein in a folded configuration, the container forms a display container, and said display portion is detached from said front wall panel at said separation region and folded along said fold between said first and second display panels, the folded first and second display panels thereby forming an erect display panel.

6. In combination with at least one packaged dental floss article, a foldable container comprising:

a top wall panel having a display portion, said display portion having first and second display panels, said first and second display panels being hingedly connected by a fold;

a front wall panel having an inner edge hingedly connected to said top wall panel by a fold and separably connected to said display portion of said top wall panel at a separation region;

a back wall panel having an inner edge hingedly connected to said top wall panel by a fold;

first and second side wall panels, each side wall panel having an inner edge interconnected by a fold to said top wall panel, and each of said first and second side wall panels including a detachable access panel; and a bottom wall panel hingedly connected by a fold to one of said first and second side wall panels, said bottom wall panel including a connecting flap;

wherein in a folded state, the container forms a display container, and said display portion is detached from said front wall panel at said separation region and folded along said fold between said first and second display panels, the folded first and second display panels thereby forming an erect display panel;

wherein the at least one packaged dental floss article is disposed within said foldable container for shipment to a predetermined site of distribution and the at least one packaged dental floss article is dispensed from said foldable container at said predetermined site of distribution.

* * * * *